US006683238B1

(12) United States Patent
Driscoll, Jr.

(10) Patent No.: US 6,683,238 B1
(45) Date of Patent: Jan. 27, 2004

(54) OBOE REED GOUGING DEVICE

(76) Inventor: Robert W. Driscoll, Jr., 1655 Streator Ave., Washington, PA (US) 15301

( * ) Notice: Subject to any disclaimer, the term of this patent is extended or adjusted under 35 U.S.C. 154(b) by 5 days.

(21) Appl. No.: 10/228,585

(22) Filed: Aug. 27, 2002

(51) Int. Cl.[7] ..... G10D 9/02
(52) U.S. Cl. ..... 84/383 A; 84/453
(58) Field of Search ..... 84/383 A, 453; 144/369

(56) References Cited

U.S. PATENT DOCUMENTS 4,708,182 A * 11/1987 Laker ..... 144/369
5,127,778 A * 7/1992 Scheer ..... 409/132

FOREIGN PATENT DOCUMENTS

FR 2639457 * 5/1990

* cited by examiner

*Primary Examiner*—Shih-Yung Hsieh
(74) *Attorney, Agent, or Firm*—Aileen Champion Addessi

(57) ABSTRACT

An oboe reed gouging device includes a base, a pair of pedestals, a rod supported between the pedestals, and a bed pivotally attached to the base for holding a cane to be gouged into an oboe reed. The oboe reed gouging device further includes a first and second carriage portion which houses a blade. The two part construction of the carriage enables adjustment of the blade with respect to the bed without movement of the bed. The blade is held by a pair of cylinders for providing greater surface contact on the blade to prevent pivotal movement of the blade. The blade can be advanced and retracted by a pushing screw having a collar and a groove engagable with a pair of pins. Each of the adjustments, including an adjustment of the bed with respect to the rod, can be made with a single adjustment, making re-adjustment easy.

27 Claims, 4 Drawing Sheets

OBOE REED GOUGING DEVICE

BACKGROUND OF THE INVENTION

The invention relates to the production of an oboe reed from a piece of cane and, more particularly, to an oboe reed gouging device having a limited degree of adjustment for the components of the device for enabling an oboist to produce his or her own oboe reeds.

An oboe is a musical instrument that uses a reed made from bamboo to create its sound. The oboist blows into a reed, which is made from two pieces of bamboo, or cane, that is strapped together and whittled or thinned in a very specific manner so that they vibrate against one another when air is blown between them. This vibration produces a sound that is then manipulated by the oboe to produce the different notes that are played. The manner in which the reed vibrates controls the quality of the sound or tone that the instrument produces. Altering the curve, symmetry, and thickness of the reed changes the sound produced by the oboe. Typically, the reeds are hand-made by the individual musician to meet their standards.

In the past, the gouge curve was cut with hand chisels and sand paper. This was not a very accurate or consistent process and resulted in lower quality reeds for the musician.

Currently, gouging machines are used to cut a curved surface onto the inside of the cane. Gouging machines control the action of a chisel-type curved planing blade that removes the soft material from the inside of bamboo or cane. The resulting contour cut into the bamboo is called the gouger curve. This curve is a critical element in controlling the sound or tone of the oboe reed. The shape of the curve resembles a crescent moon. The curve is thick in the center and tapers at a specific rate to the sides. A gouging machine needs to be able to control this taper and be able to adjust it according to the taste of the musician.

One example of a gouging machine is a double-radius gouge having a blade that cuts slightly off-center so that only one side of the cutter blade contour is cutting out cane. The cane is flipped repeatedly in its holder and re-gouged until the final dimensions are met.

Another type of gouging machine is a single radius gouge, which cuts down the middle of the cane without flipping the cane in the holder. Both sides of the taper are cut at the same time by the blade contour.

To change the measurements that are cut into the cane, the blade is adjusted. Some machines use a set of inclined planes that can be raised or lowered, or a wheel that acts as a stop.

To change the thickness of the gouge contour near the thinnest part of the taper, the location of the bed holding the cane is adjusted in relation to the blade. This causes either a greater or lesser displacement of the overlapping contours of the double-radius gouge.

However, ease of adjustment is a problem with the designs of currently existing gouging machines. To make any adjustment in the measurements of the contour, several different screws and adjustment mechanisms must be manipulated to effect a single measurement alteration. For example, if the two screws which control movement and/or alignment of the bed are not turned exactly the same amount, the bed will not be parallel to the main rod and the gouge contour will not be centered on the cane. It is very difficult to undo an experimental change if the results are not as hoped. For this reason, many oboists need an expert to make the adjustments. Since oboe reeds are tailored so specifically to each player, it is important that each player have the ability to make modifications to their machine and tweak the measurements produced until it best suits their individual needs.

Therefore, what is needed is an apparatus for gouging oboe reeds which utilizes a single adjustment mechanism for each adjustment made by an oboist for altering the contour and design of the reed.

SUMMARY OF THE INVENTION

An oboe reed gouging device for making an oboe reed includes a base having a first surface and an oppositely positioned second surface, a pair of pedestals attached to and extending upwardly from the first surface of the base, and a rod attached to and extending between the pedestals for mounting the rod in spaced apart relation to the first surface of the base. A bed is pivotally attached to the first surface of the base for holding an oboe reed material during gouging of the oboe reed material for making the oboe reed. The bed is positioned substantially parallel to the rod for positioning the oboe reed material substantially parallel to the rod. A carriage is slidably attached to the rod and engagable with the bed. The carriage may have a first carriage portion and a second carriage portion adjustable with respect to one another with the first carriage portion mounted on the rod and the second carriage portion movable toward and away from the bed A blade is positionable within the second carriage portion of the carriage for contacting and gouging the oboe reed material positioned on the bed of the oboe reed gouging device.

The oboe reed gouging device may further include a blade grip mechanism attached to the carriage and contactable with the blade. The blade grip mechanism includes a pair of cylinders, each cylinder having a substantially flat edge for contacting the side edges of the blade for substantially preventing pivotal movement of the blade. The oboe reed gouging device may also includes a blade advancing mechanism having a pushing screw attached to the blade, a collar and a knob attached to the pushing screw, and a groove positioned therebetween. Locating pins extending from the carriage are positioned within the groove for holding the blade within the carriage and for enabling the pushing screw to remain stationary as the blade advances and retracts.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
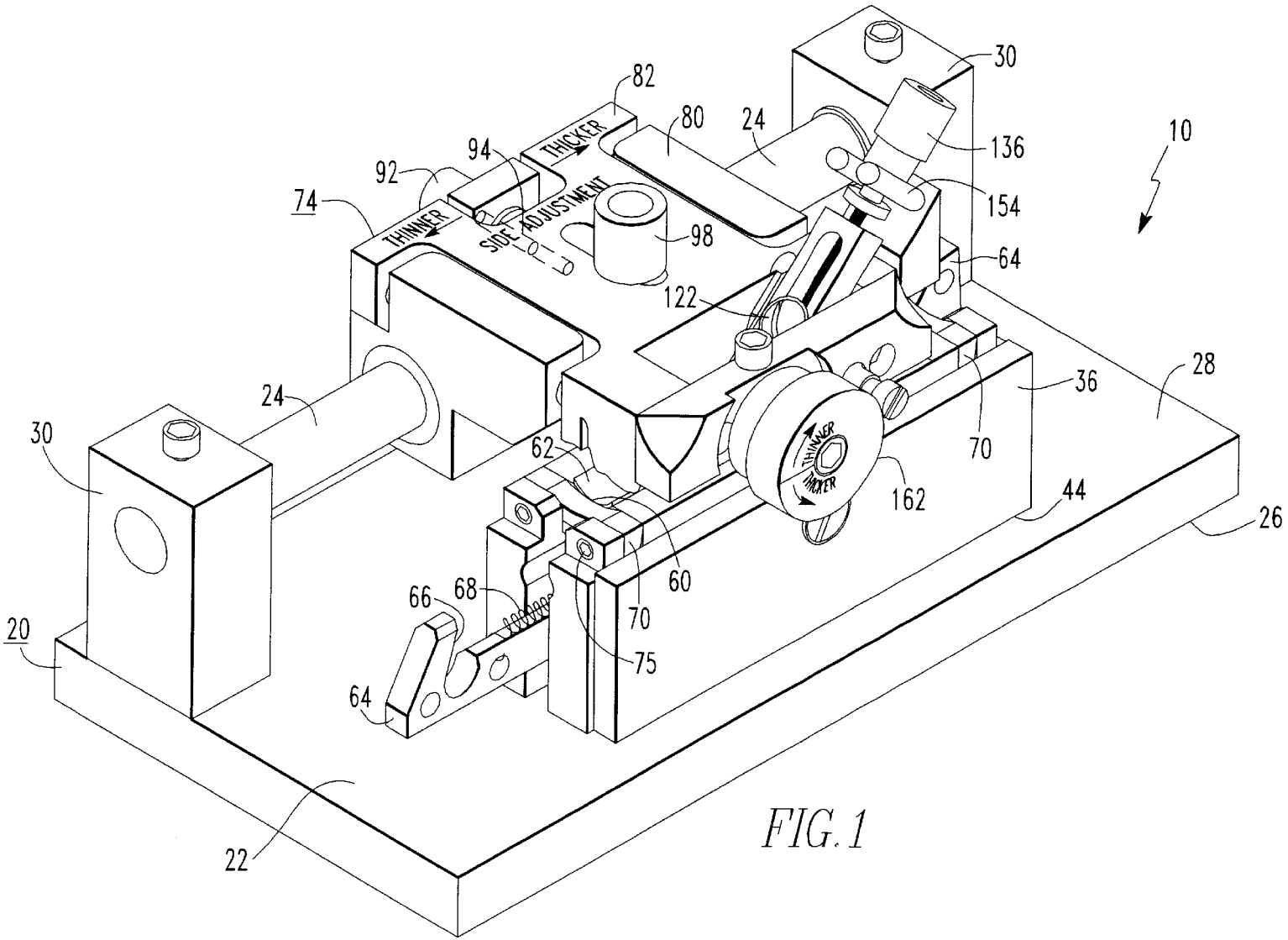
FIG. 1 is an isometric view of an oboe reed gouging device.
Figure 2:
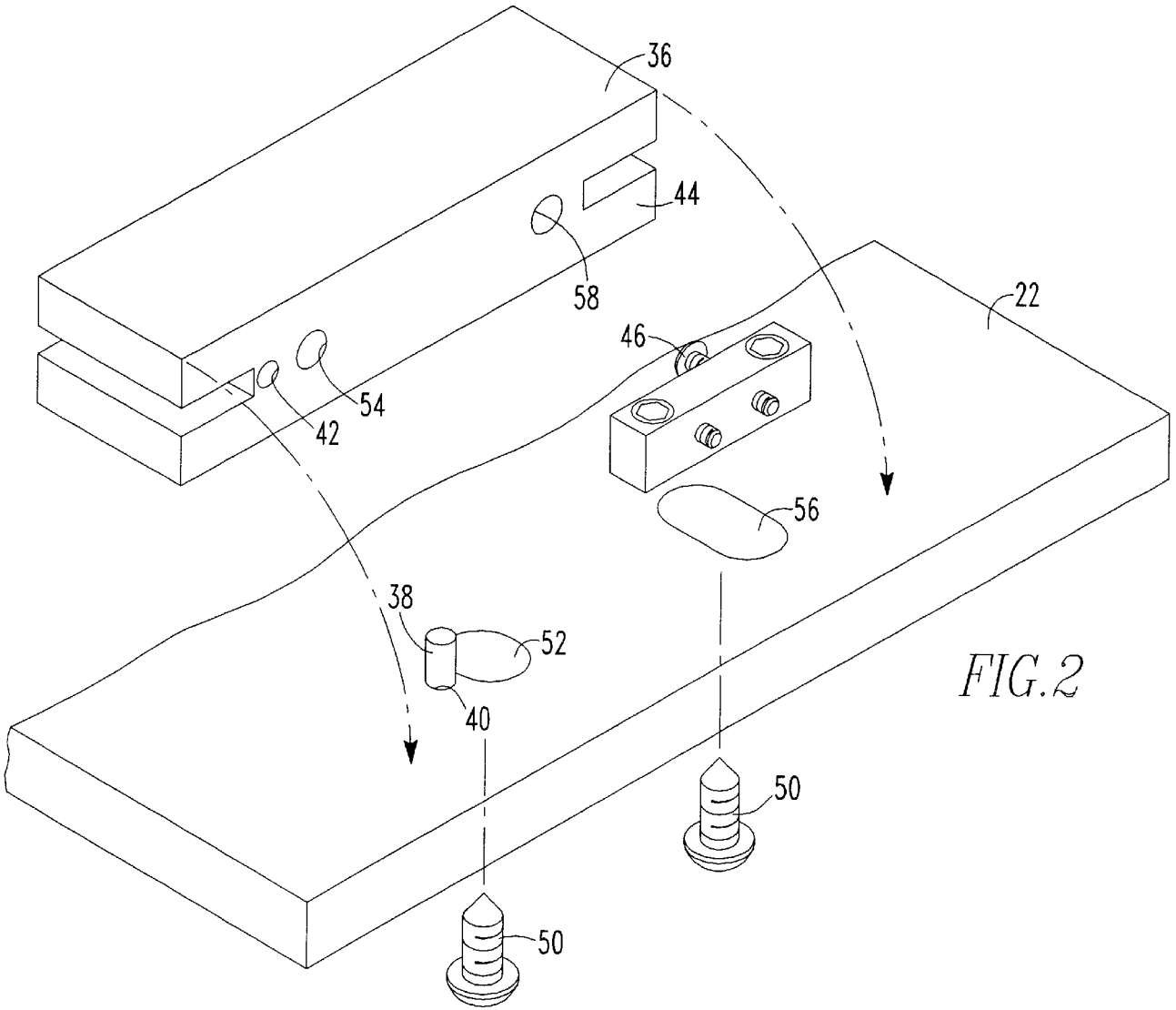
FIG. 2 is a partially exploded view of a bed and a base of the oboe reed gouging device.
Figure 3:
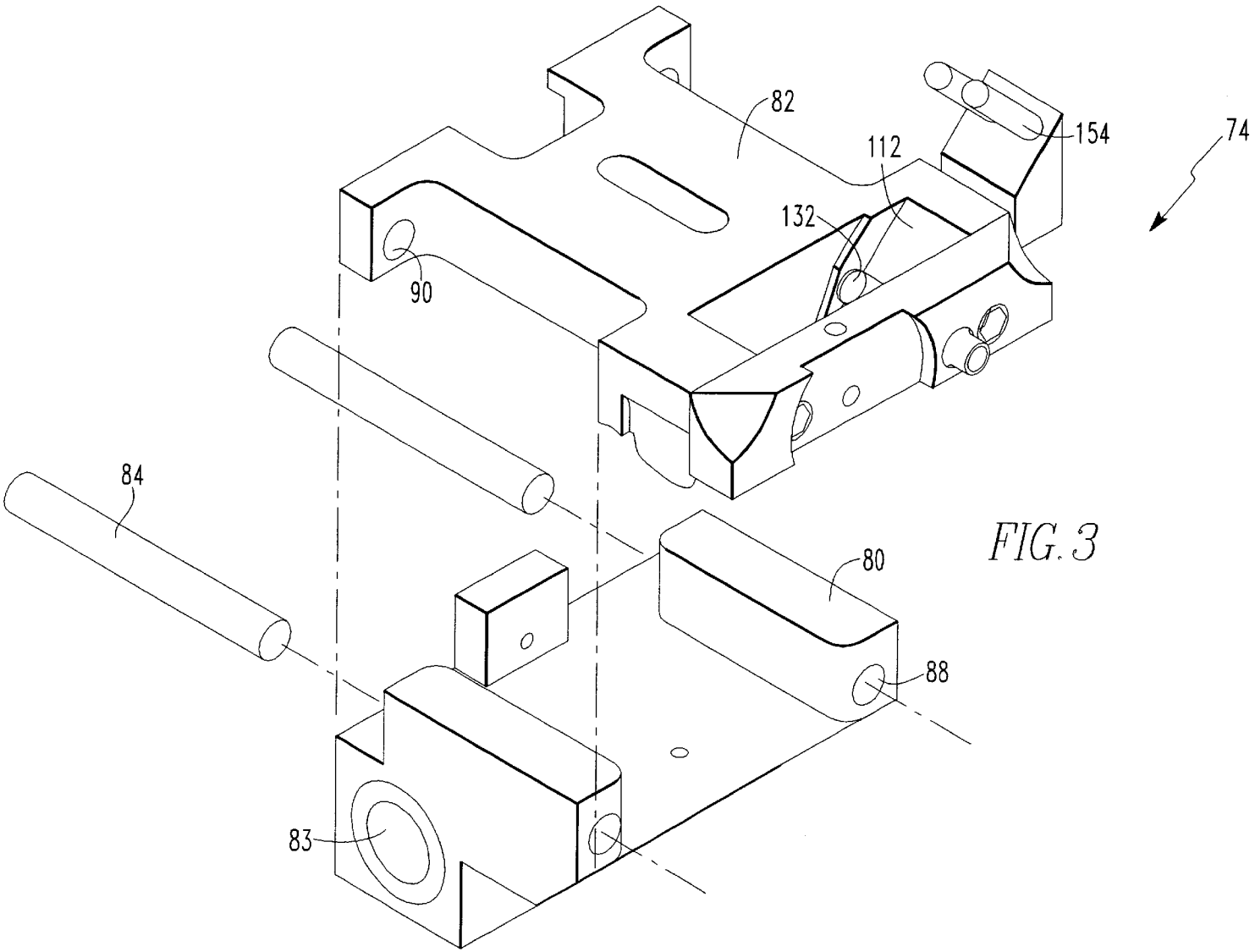
FIG. 3 is an exploded view of a first and a second carriage of the oboe reed gouging device.
Figure 4:
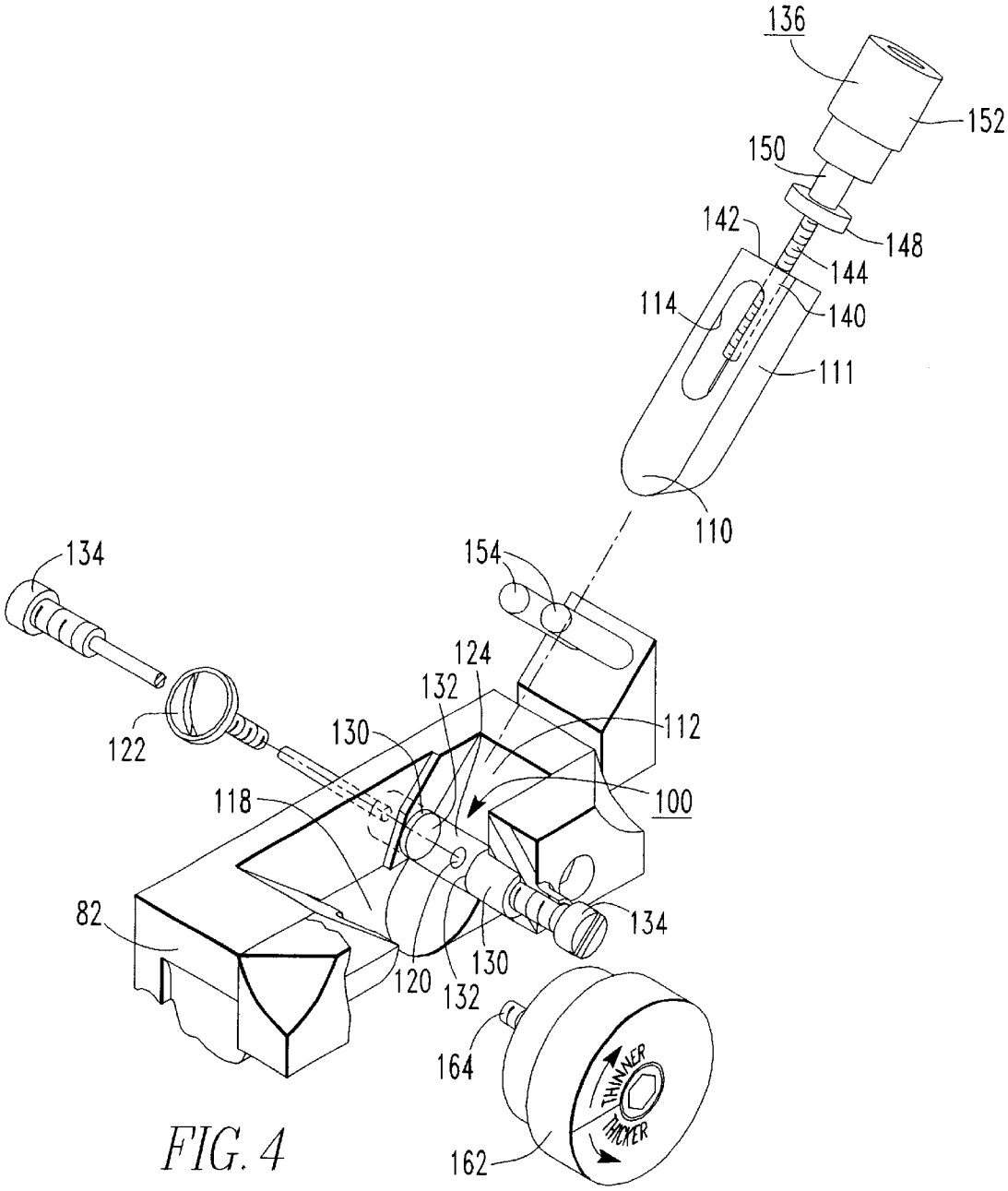
FIG. 4 is partially exploded view of a blade of the oboe reed gouging device.
Figure 5:
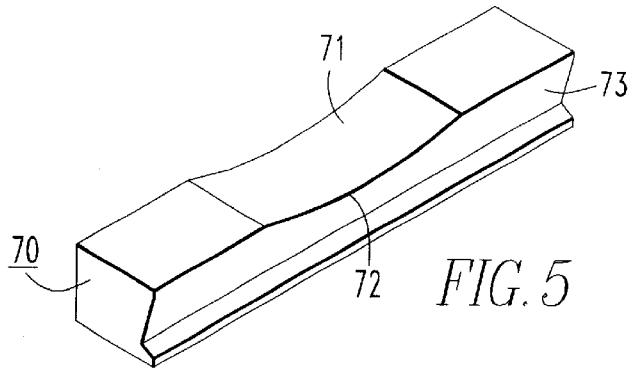
FIG. 5 is a view of a cane stop bar of the oboe reed gouging device.

Referring to FIG. 1, a machine for making an oboe reed from a piece of material, such as a piece of cane or other suitable material, is an oboe reed gouging device 10. The oboe reed gouging device 10 includes a main body assembly 20, which includes a base 22, a rod 24, and pedestals 30. The base 22 provides a surface for holding the components of the oboe reed gouging device 10. The base 22 has a first substantially flat surface 26, which may be positioned on a surface, such as a table top, desk, floor, or the like. The base 22 has a second surface 28 upon which the components of the device 10 are positioned.

The rod 24 is suspended above the base 22 by first and second pedestals 30, and is held in a stationary position therebetween. The rod 24 is a cylindrical elongated member.

The oboe reed gouging device 10 further includes a bed 36 pivotally attached to the base 22 of the main body assembly 20. The position of the bed 36 is adjustable for aligning the bed 36 with the rod 24. Preferably, the bed 36 and the rod 24 are positioned parallel to one another. A pin 38 is positioned within an aperture 40 in the base 22 and within an aperture 42 in the bottom surface 44 in the bed 36 for enabling the bed 36 to pivot about the pin 38. The position of the bed 36 can be controlled by a single adjustment mechanism, such as an adjustment screw 46 or any other suitable type of adjustment device. The adjustment screw 46 may be turned to pivot the bed 36 toward or away from the rod 24. After adjustment of the bed 36, the bed 36 may be secured to the base 22 and held in position by fasteners, such as screws 50, bolts, or the like. Preferably, the screws 50 remain within a hole 52 and a hole 54 of the base 22 and the bed 36, respectively, and within a slot 56 and a hole 58 of the base 22 and the bed 36, respectively, and need only be loosened to adjust the position of the bed 36 and, then re-tightened. The slot 56 enables the bed 36 to pivot while the screw 50 remains partially threaded into the bed 36.

The bed 36 further includes a recess 60 extending from a first end to a second end of the bed 36 for positioning of an oboe reed material 62 during the gouging process. A clip 64 is pivotally attached to the bed 36 for holding the reed material 62 securely within the recess 60. Each clip 64 may be formed of or have at least a portion 66 formed of a flexible, soft, or non-metallic material, such as plastic, rubber, nylon, or any other type of pliable material for contacting the reed material 62 to hold the reed material 62 without damaging the reed material 62. A spring 68 is attached to the clip 64 for providing tension to force the clip 64 into position about the reed material 62.

Positioned at each end of the recess 60 of the bed 36 is a cane stop bar 70 which prevents the reed material 62 from sliding out of the recess 60 during the manufacturing process. The cane stop bar 70 includes a recess 71 alignable with the recess 60 of the bed 36. When positioned on the bed 36, a lower portion 72 of the recess 71 is positioned at a higher elevation than the lower portion of the recess 60 for providing a stop for the reed material 62 The cane stop bar 70 includes an angled wall 73 which contacts the reed material 62. The angled wall 73, for example, a wall tapered at approximately a 15 degree angle or the like, provides a gripping surface for retaining and pushing against the reed material 62. The angled wall 73 is angled so that the upper portion extends toward the bed 36 and the lower portion of the angled wall 73 is spaced a distance back from the bed 36. The cane stop bar 70 may be held in position by set screws 75, bolts, or any other type of support.

The oboe reed gouging device 10 includes a carriage 74 which is also positioned on the base 22. The carriage 74 includes a first carriage portion 80 and a second carriage portion 82. The first carriage portion 80 is slidably attached to the rod 24 and may also rotate about the rod 24. The rod 24 may be inserted through a hole 83 in the first carriage portion 80. The second carriage portion 82 is movably attached to the first carriage portion 80. As one example, the second carriage portion 82 may be slidably attached to the first carriage portion 80 by a pair of connecting rods 84 which are positioned within bores 88 of the first carriage portion 80 and through bores 90 of the second carriage portion 82. An adjustment mechanism, such as a knurled knob 92 and a threaded rod 94, coupled to the connecting rods 84 and to the first and the second carriage portions 90 and 82 move the second carriage portion 82 with respect to the first carriage portion 80. An adjustment of the adjustment mechanism moves the second carriage portion 82 toward or away from the bed 36 for altering the shape of reed material 62 during the manufacturing process. After adjustment of the carriage 74, the first and second carriage portions 80 and 82 may be secured in position by a locking mechanism, such as a bolt 98 with a knurled knob, a threaded rod with a collar, or the like.

The oboe reed gouging device 10 further includes a blade grip mechanism 100. The blade grip mechanism 100 holds a blade 110, having side edges 111, for gouging the piece of cane into an oboe reed. The blade grip mechanism 100 is positioned within a slot 112 in the second carriage portion 82. The slot 112 includes a hole 118 for disposition of the blade 110 therethrough and a threaded bore 120 for insertion of a threaded screw 122, bolt, or the like, which holds the blade 110 in position within the slot 112. The blade 110 has a bore 114 for insertion therethrough of the threaded screw 122. The blade grip mechanism 100 has a pair of cylinders 130 positionable on each side of the blade 110 for gripping the blade 110 and positionable within a groove 124 in the slot 112. The cylinders 130 have a faced edge 132 which is perpendicular to the length of the cylinder 130 for providing a flat surface for contacting against the blade 110. The cylinders 130 may be adjusted by an adjustment mechanism, such as a screw 134, bolt, or the like. The adjustment of the blade 110 by the flat contact surfaces provided by the cylinders 130 enables the blade 110 to move in a parallel fashion and prevents the blade 110 from pivoting about the locking screw 122. The bottom of the blade 110 remains at the bottom of the gouge contour.

The oboe reed gouging device 10 further includes a blade advancing mechanism 136 for advancing the position of the blade 110 below the surface of the carriage for altering the cut of the blade 110 or for retracting the blade 110 back away from the bed 36. The blade advancing mechanism includes threading a hole 140 into the back 142 of the blade 110 for insertion of a pushing screw 144. The pushing screw 144 has a collar 148 with a groove 150 and a knurled knob 152. The advancing mechanism further includes a pair of pins 154 attached to the second carriage portion 82 and engagable within the groove 150 of the collar 148. The pins 154 act as a locating mechanism so that when the screw 144 is turned, the screw 144 remains stationary and the blade 110 moves. This prevents the blade 110 from becoming deformed or broken. The blade 110 can either be advanced or retracted while not damaging the locking screw 122.

To adjust the position of the second carriage portion 82 with respect to the bed 36 for adjusting the thickness of the center of the reed material 62, an adjustment mechanism is attached to the second carriage portion 82. The adjustment mechanism includes a concentric wheel 162 having a knurled edge attached to and offset from an eccentric shaft 164. Rotation of the wheel 162 controls the drop or lowering of the carriage 74 and provides a stop for the carriage 74.

In operation, a person inserts the cane 62 onto the bed 36 and positions the clips 64 against the cane 62 for holding the cane 62 in the recess 60 of the bed 36. The bed 36 is adjusted with respect to the rod 24 by loosening the screws 50 and pivoting the bed 36 about pin 40. The screw 46 can be adjusted for slightly altering the position of the bed 36. After the desired position is obtained, then the screws 50 can be tightened for securing the bed 36 to the base 22.

The blade 110 is inserted into the slot 112 in the carriage 74. A screw 122 is positioned within a bore 114 in the blade 110 and into the threaded bore 120 of the carriage 74 for securing the blade 110 within the carriage 74. The cylinders 130 are tightened against the blade 110 by adjusting screws 134. The knurled knob 152 is rotated until the blade 110 is advanced through the hole 118 in the carriage 74 and contacts the reed material 62. Then, the screw 122 is tightened for securely holding the blade 110 in position.

To adjust the position of the first and second carriage portions 80 and 82, the screw 98 is loosened. Then, the screw 92 is rotated enabling the second carriage to move toward and away from the bed 36. After the blade 110 is in the desired position, the screw 98 is re-tightened.

The concentric wheel 162 is rotated for altering the position of the carriage 74 with respect to the bed 36. After completion of the adjustments, the oboe reed gouging device 10 can be used for gouging a piece of cane or oboe reed material 62 into an oboe reed.

An advantage of the oboe reed gouging device is that an oboist may easily adjust the machine. If the results of a change are not as expected, it can be undone simply and accurately. This is accomplished because every adjustment is made with the movement of only one adjustment mechanism.

Another advantage of the oboe reed gouging device 10 is that the carriage 74 is in two pieces. This eliminates the need to alter the position of the bed 36, as required by previous gouging machines. To change the thickness of the sides of the gouge contour, only one screw 92 is turned to displace the half of the carriage containing the blade 110 away from or towards the main rod 24. This displacement has the same effect as moving the bed 36 closer or further from the main rod 24. If the oboist does not like the results of a change in the setup, only the one screw 92 that was turned needs to be re-adjusted. The bed location is not changed so there is no change to the relationship of the bed 36 to the rod 24.

Yet another advantage of the oboe reed gouging device 10 is that the bed 36 rotates in a radial fashion. This eliminates the need for a free floating bed, as required by previous gouging machines. For the gouging device 10, movement of the bed 36 is only done if the bed 36 is not parallel to the rod 24. Once the bed 36 is adjusted to be parallel to the main rod 24, it is tightened into that position and stays that way. Also, the manipulation of the bed 36 is regulated by one adjustment screw 46 on the side of the bed 36. If the bed 36 is adjusted out of parallel too far, only one screw 46 needs to be turned back to undo the changes.

Yet another advantage of the oboe reed gouging device 10 is the blade grip system. Since the blade 110 is positioned between two surfaces, as compared to two "point contacts" as in previous machines, the blade 110 moves in a parallel fashion when the blade 110 is pushed from side to side by the cylinders 130 and does not pivot around the locking screw 122. The bottom of the blade 110 remains at the bottom of the gouge contour. With the "point contact" of previous machines, the blade had a tendency to pivot around the locking screw causing the bottom of the blade curve to rotate into a position that may not be the bottom of the gouge curve, which changes the taper of the contour and is not desirable. Also, for the gouging device 10, each cylinder 130 is adjusted by a single screw 134, making any re-adjustments easy.

Yet another advantage of the oboe reed gouging device 10 is the blade advancing mechanism, which has a pushing screw 144 with a special collar 148 attached to it. The collar 148 and pins 154 prevent the blade 110 from becoming deformed or broken. Also, the blade 110 can be both advanced and retracted while not damaging the locking screw 122. In previous designs, the blade either has a T-slot which often bends, binds or breaks off, or a threaded screw pushes against the shaft of the locking screw, which only allows the blade to retract and damages the threads of the locking screw by pressing into them. Also, the blade 110 of the oboe reed gouging device 10 can be easily removed from the machine if needed and replaced with great accuracy.

Yet another advantage is the design of the concentric wheel 162 and the eccentric shaft 164 for altering the position of the second carriage portion 82 with respect to the bed 36.

Yet another advantage of the oboe reed gouging device 10 is the cane stop mechanism 70 for the bed 36, which prevents the cane from sliding out of the bed 36 while the cane is being processed. The angled wall 73 acts as a stop, while the recess 71 enables the blade 110 to travel through the cane stop bar 70 to cut along the entire length of the reed material 62 during the manufacturing process.

Thus there has been shown and described a novel oboe reed gouging device which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. An oboe reed gouging device for making an oboe reed, comprising:

a base having a first surface and an oppositely positioned second surface;

a pair of pedestals attached to and extending upwardly from the first surface of the base;

a rod attached to and extending between the pedestals for mounting the rod in spaced apart relation to the first surface of the base;

a bed movably mounted to the first surface of the base for holding an oboe reed material during gouging of the oboe reed material for making the oboe reed, the bed positioned substantially parallel to the rod for positioning the oboe reed material substantially parallel to the rod;

a carriage slidably attached to the rod and engagable with the bed, the carriage having a first carriage portion and a second carriage portion adjustable with respect to one another, the first carriage portion mounted on the rod and the second carriage portion movable toward and away from the bed; and a blade positionable within the second carriage portion of the carriage for contacting and gouging the oboe reed material positioned on the bed of the oboe reed gouging device.

2. The oboe reed gouging device according to claim 1, further comprising an adjustment mechanism attached to the carriage, the adjustment mechanism including:

a threaded rod attached to the first carriage portion and to the second carriage portion; and a knob attached to the threaded rod for enabling a person to grasp the knob for rotation of the threaded rod to move the second carriage portion toward and away from the first carriage portion for altering the position of the second carriage portion with respect to the bed.

3. The oboe reed gouging device according to claim 1, further comprising a locking mechanism engagable with the first and the second carriage portions for securing the first and second carriage portions together.

4. The oboe reed gouging device according to claim 1, wherein the first and second carriage portions are joined together by a pair of connecting rods.

5. The oboe reed gouging device according to claim 1, further comprising:

the bed having a recess for holding the oboe reed material during gouging of the oboe reed material; and a cane stop bar positioned adjacent to the recess on the bed and having a recess alignable with the recess of the bed for allowing the blade to pass through the recess of the cane stop bar for cutting the entire reed material positioned within the recess of the bed, the cane stop bar further having an angled wall positioned adjacent to the recess of the bed and extending above and toward the recess of the bed for contacting and providing a stop for the reed material to prevent the reed material from sliding out of the recess of the bed during the manufacturing process.

6. The oboe reed gouging device according to claim 1, further comprising an adjustment mechanism attached to the second carriage portion including a concentric wheel for altering the position of the carriage with respect to the bed.

7. The oboe reed gouging device according to claim 1, further comprising:

a blade grip mechanism including a first cylinder having a first faced edge and a second cylinder having a second faced edge; and the blade positioned between the first and second faced edges of the first and second cylinders for enabling the blade to move parallel when pushed from side to side by the first and second cylinders.

8. The oboe reed gouging device according to claim 1, wherein the bed is pivotally attached to the base for adjusting the bed with respect to the rod.

9. The oboe reed gouging device according to claim 1, further comprising:

a blade advancing mechanism including a pushing screw attached to the blade, a collar and a knob attached to the pushing screw, and a groove positioned therebetween; and the carriage including a pair of locating pins extending therefrom, the locating pins positioned within the groove of the blade advancing mechanism for holding the blade within the carriage and for enabling the pushing screw to remain stationary as the blade advances and retracts.

10. An oboe reed gouging device for making an oboe reed, comprising:

a base having a first surface and an oppositely positioned second surface;

a pair of pedestals attached to and extending upwardly from the first surface of the base;

a rod attached to and extending between the pedestals for mounting the rod in spaced apart relation to the first surface of the base;

a bed mounted on the first surface of the base and pivotally attached to the base for adjusting the bed with respect to the rod, an oboe reed material positionable on the bed during gouging of the oboe reed material for making the oboe reed, the bed positioned substantially parallel to the rod for positioning the oboe reed material substantially parallel to the rod;

a carriage slidably attached to the rod and engagable with the bed; and a blade positionable within the carriage for contacting and gouging the oboe reed material positioned on the bed of the oboe reed gouging device.

11. The oboe reed gouging device according to claim 10, further comprising:

the base having a hole therethrough, having a pin extending upwardly from the first surface, and having a slot therethrough;

at least one fastener disposable within the hole and within the slot of the base; and the bed having a first hole alignable with the pin extending from the base, a second hole alignable with the hole of the base and a third hole alignable with the slot in the base enabling the bed to pivot about the pin and to be secured in position by disposing the at least one fastener through the aligned holes and the slot of the bed and the base.

12. The oboe reed gouging device according to claim 11, further comprising an adjustment mechanism attached to base and positioned contacting the bed for providing pressure to the bed to pivot the bed about the pin and adjust the position of the bed with respect to the base and with respect to the rod.

13. The oboe reed gouging device according to claim 10, further comprising:

the bed having a first end and a second end, the oboe reed material positionable therebetween; and a cane stop bar positioned at each of the first and second ends of the bed and having an angled wall extending toward the bed for contacting and retaining the oboe reed material on the bed during gouging of the oboe reed material by the blade.

14. The oboe reed gouging device according to claim 10, further comprising a clip attached to the bed and formed of a pliable material for contacting and retaining the oboe reed material on the bed.

15. The oboe reed gouging device according to claim 10, further comprising:

a blade grip mechanism including a first cylinder having a first faced edge and a second cylinder having a second faced edge; and the blade positioned between the first and second faced edges of the first and second cylinders for enabling the blade to move parallel when pushed from side to side by the first and second cylinders.

16. The oboe reed gouging device according to claim 10, further comprising:

a blade advancing mechanism including a pushing screw attached to the blade, a collar and a knob attached to the pushing screw and a groove positioned therebetween; and the carriage including a pair of locating pins extending therefrom, the locating pins positioned within the groove of the blade advancing mechanism for holding the blade within the carriage and for enabling the pushing screw to remain stationary as the blade advances and retracts.

17. The oboe reed gouging device according to claim 10, wherein the carriage further includes a first carriage portion and a second carriage portion adjustable with respect to one another, the first carriage portion mounted on the rod and the second carriage portion movable toward and away from the bed.

18. An oboe reed gouging device for making an oboe reed, comprising:

a base having a first surface and an oppositely positioned second surface;

a pair of pedestals attached to and extending upwardly from the first surface of the base;

a rod attached to and extending between the pedestals for mounting the rod in spaced apart relation to the first surface of the base;

a bed movably mounted to the first surface of the base for holding an oboe reed material during gouging of the oboe reed material for making the oboe reed, the bed positioned substantially parallel to the rod for positioning the oboe reed material substantially parallel to the rod;

a carriage slidably attached to the rod and engagable with the bed;

a blade having side edges positionable within the carriage for contacting and gouging the oboe reed material positioned on the bed; and a blade grip mechanism attached to the carriage and contactable with the blade, the blade grip mechanism having a pair of cylinders, each cylinder having a substantially flat edge for contacting the side edges of the blade for substantially preventing pivotal movement of the blade.

19. The oboe reed gouging device according to claim 18, wherein the blade grip mechanism further comprises an adjustment mechanism threadedly coupled to the cylinders for adjusting the position of the cylinders.

20. The oboe reed gouging device according to claim 18, wherein the bed is pivotally attached to the base for adjusting the bed with respect to the rod.

21. The oboe reed gouging device according to claim 18, further comprising:

a blade advancing mechanism including a pushing screw attached to the blade, a collar and a knob attached to the pushing screw, and a groove positioned therebetween; and the carriage having a pair of locating pins extending therefrom, the locating pins positioned within the groove for holding the blade within the carriage and for enabling the pushing screw to remain stationary as the blade advances and retracts.

22. The oboe reed gouging device according to claim 18, wherein the carriage includes a first carriage portion and a second carriage portion adjustable with respect to one another, the first carriage portion mounted on the rod and the second carriage portion movable toward and away from the bed.

23. An oboe reed gouging device for making an oboe reed, comprising:

a base having a first surface and an oppositely positioned second surface;

a pair of pedestals attached to and extending upwardly from the first surface of the base;

a rod attached to and extending between the pedestals for mounting the rod in spaced apart relation to the first surface of the base;

a bed movably mounted to the first surface of the base for holding an oboe reed material during gouging of the oboe reed material for making the oboe reed, the bed positioned substantially parallel to the rod for positioning the oboe reed material substantially parallel to the rod;

a carriage slidably attached to the rod and engagable with the bed, the carriage having a slot and a pair of locating pins extending adjacent to the slot;

a blade positionable within the slot of the carriage for contacting and gouging the oboe reed material positioned on the bed; and a blade advancing mechanism including a pushing screw attached to the blade, a collar and a knob attached to the pushing screw, and a groove positioned between the collar and the knob, the locating pins extending from the carriage positioned within the groove of the blade advancing mechanism for holding the blade within the carriage and for enabling the pushing screw to remain stationary as the blade advances and retracts.

24. The oboe reed gouging device according to claim 23, further comprising:

the blade having a bore;

the carriage having a bore; and a threaded screw disposable within the bore of the blade and within the bore of the carriage for retaining the blade within the carriage.

25. The oboe reed gouging device according to claim 23, further comprising:

a blade grip mechanism including a first cylinder having a first faced edge and a second cylinder having a second faced edge; and the blade positioned between the first and second faced edges of the first and second cylinders for enabling the blade to move parallel when pushed from side to side by the first and second cylinders.

26. The oboe reed gouging device according to claim 23, wherein the bed is pivotally attached to the base for adjusting the bed with respect to the rod.

27. The oboe reed gouging device according to claim 23, wherein the carriage has a first carriage portion and a second carriage portion adjustable with respect to one another, the first carriage portion mounted on the rod and the second carriage portion movable toward and away from the bed.

* * * * *